US005810938A

United States Patent [19]

Murphy

[11] Patent Number: 5,810,938

[45] Date of Patent: Sep. 22, 1998

[54] METAL BRIGHTENING COMPOSITION AND PROCESS THAT DO NOT DAMAGE GLASS

[75] Inventor: Donald P. Murphy, Rochester Hills, Mich.

[73] Assignee: Henkel Corporation, Plymouth Meeting, Pa.

[21] Appl. No.: 651,184

[22] Filed: May 24, 1996

[51] Int. Cl.[6] ..... C03C 23/00; C23G 1/02

[52] U.S. Cl. ..... 134/2; 134/3; 216/103; 216/104

[58] Field of Search ..... 216/102, 103, 216/104, 97; 252/79.1, 79.3, 79.4, 79.2, 80; 134/3, 2

[56] References Cited

U.S. PATENT DOCUMENTS 5,393,447 2/1995 Carlson et al. ..... 252/101

FOREIGN PATENT DOCUMENTS 1103853 6/1995 China .
55-107782 8/1980 Japan .
58-110681 7/1983 Japan .
03130391 6/1991 Japan .
629179 10/1978 U.S.S.R. .
8501302 3/1985 WIPO .

*Primary Examiner*—R. Bruce Breneman
*Assistant Examiner*—George Goudreau
*Attorney, Agent, or Firm*—Ernest G. Szoke; Wayne C. Jaeschke; Norvell E. Wisdom, Jr.

[57] ABSTRACT

An aqueous liquid composition containing acid fluoride ions (i.e., $HF_2^-$) not derived from hydrogen fluoride, together with an acid stronger than acid fluoride ions, and, preferably, surfactant, is very effective in brightening unpainted metal surfaces such as those of stainless steel and aluminum without reducing the transparency of any glass objects such as windows with which the composition may come into contact. Otherwise similar compositions containing aqueous hydrofluoric acid usually etch glass in such a way as to reduce its transparency. The invention is particularly useful for brightening soiled or otherwise darkened surfaces of rail passenger cars.

18 Claims, No Drawings

METAL BRIGHTENING COMPOSITION AND PROCESS THAT DO NOT DAMAGE GLASS

BACKGROUND OF THE INVENTION

1. Field of the Invention

This invention relates to brightening, and often at the same time cleaning, metallic surfaces, more particularly when the metal surfaces are adjacent to surfaces of glass that can not conveniently be protected against contact with the same brightening composition as the adjacent glass. This invention also relates to brightening compositions that are useful for such processes.

2. Statement of Related Art

Many commercially available metal alloys, particularly various stainless steels and aluminum alloys, are often used for structural purposes without any protective coating of paint or a like material, because their natural metallic luster is aesthetically appealing. Metallic luster is all too easily marred during use of such articles by accumulated soils of various types, and/or by slow thickening of the natural oxide layers that protect such metallic materials against the sort of extensive corrosion that would occur on carbon steel, galvanized steel, or the like upon exposure to similar environments without a protective coating. Therefore, periodic brightening, which may include cleaning, is necessary to maintain the aesthetic appeal of such unpainted metallic surfaces.

It is known in the art that most metallic surfaces with a composition suitable for outdoor use without protective coatings can be effectively cleaned and brightened by acidic aqueous cleaning compositions containing dissolved hydrogen fluoride. However, it is also known that such compositions can easily damage the transparency of glass by etching it. Therefore, when an object, such as a rail transit vehicle, that includes both bright metallic surfaces and glass windows in close proximity is to be cleaned, the conventional brightening cleaners for the metallic parts of the surface alone are not suitable for use unless the glass windows are physically protected from exposure to the cleaners, and such protection is usually uneconomically laborious.

DESCRIPTION OF THE INVENTION

Object of the Invention

Major objects of the present invention are to provide compositions and/or processes that (i) effectively brighten, and if necessary for brightening also clean, unpainted metal surfaces and (ii) do not substantially damage or diminish the transparency of glass surfaces, particularly those of glass windows, with which the compositions may come into contact during the brightening of neighboring metallic surfaces and, preferably, also (iii) are not susceptible to becoming malodorous as a result of infestation from commonly ambient micro-organisms, (iv) are suitable for use by spraying, so that they may conveniently be applied to large surfaces, and/or (v) readily form stable foams that will remain in contact with surfaces for at least several minutes after application without draining away under the influence of natural gravity. Other objects will be apparent from the description below.

General Principles of Description

Except in the claims and the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; the term "paint" and its grammatical variations includes not only materials normally described as paints but all similar protective coating materials having an at least partially organic continuous phase, which may often be called more specialized names such as enamel, lacquer, top coat, plastisol coating, radiation cured coatings, photochemically cured coatings, and the like; chemical descriptions of neutral and ionic materials apply to the materials at the time of addition to any combination specified in the description and/or of generation of such materials in situ within a complete composition according to the invention or a precursor composition therefor by chemical reactions identified in the description, and do not necessarily preclude other known or unknown chemical changes to the materials as a result of reaction in the combination; in addition, specification of materials in ionic form means that the materials are supplied to prepare the compositions containing them in the form of soluble salts containing the ions specified and/or are generated in situ by chemical reactions specified in the description and implies the presence in any composition specified to contain ionic materials of sufficient counterions to produce electrical neutrality for the composition as a whole; and any counterions thus implicitly specified preferably are selected from among other constituents explicitly specified in ionic form, to the extent possible; otherwise such counterions may be freely selected, except for avoiding counterions that act adversely to the objects of the invention.

SUMMARY OF THE INVENTION

Liquid cleaning compositions according to the invention comprise, preferably consist essentially of, or more preferably consist of, water and:

(A) acid fluoride (i.e., $HF_2^-$) ions not provided by hydrogen fluoride or its aqueous solutions;

(B) a component of acid(s) with a higher ionization constant $HF_2^-$ions; and, optionally, one or more of:

(C) a component of surfactant(s), exclusive of any surfactants that are part of any of the previously recited components;

(D) a component of oxidizing agent(s), exclusive of any that are part of any of the previously recited components;

(E) a component of pH indicator(s), exclusive of any that are part of any of the previously recited components;

(F) a component of biocidal material(s), exclusive of any that are part of any of the previously recited components;

(G) odorant(s) and/or colorant(s), exclusive of any that are part of any of the previously recited components; and (H) a component of hydrotroping agent(s), other than those that are part of any of the previously recited components.

These compositions according to the invention may be either working compositions, suitable for direct use in brightening, or concentrate compositions, suitable for dilution with additional water to produce a working composition.

A process according to the invention comprises at least a step of contacting a dulled metallic surface with a liquid brightening composition according to the invention as defined herein for a sufficient time that, after completion of contact between the liquid brightening composition and the initially dulled surface and rinsing of the initially dulled surface with water, and without any use on the initially dulled metallic surface of abrasive grits or like mechanical polishing materials and without the application to the initially dulled metallic surface of any external electromotive force, the luster (i.e., percent reflectivity for visible while light) of the metallic surface is greater than it was before contact with the liquid brightening composition. (A metallic surface is defined as "dulled" herein if it has less luster than is consistent with its degree of surface smoothness and with the presence on the surface of any oxide or similar layer that spontaneously forms on a clean surface of the same metallic composition within ten minutes upon exposure to the natural ambient atmosphere.)

DETAILED DESCRIPTION OF THE INVENTION, INCLUDING PREFERRED EMBODIMENTS

Compositions according to the invention preferably have no evidence of phase stratification visible to unaided normal human vision; i.e., the compositions may be cloudy or otherwise show evidence of suspended second phases, but preferably do not stratify into more than one liquid layer or contain any solid particles large enough to see individually with unaided normal human vision. If this condition is not fulfilled, there is always some danger of concentration variations due to inhomogeneity of the composition.

The acid fluoride (alternatively called "bifluoride") ions required for component (A) can be supplied by any sufficiently water soluble salt including such ions. Hydrogen fluoride and its aqueous solutions should not be used, because compositions containing them are far more likely to etch or otherwise adversely affect glass surfaces with which they come into contact than are compositions according to this invention. For reasons of economy and high solubility, ammonium acid fluoride is generally preferred as the source of component (A). Irrespective of the source, a working composition according to the invention preferably contains a concentration of at least, with increasing preference in the order given, 0.010, 0.030, 0.050, 0.060, 0.070, 0.080, 0.090, 0.100, 0.110, 0.115, 0.120, 0.125, or 0.130 moles of acid fluoride ions per kilogram of total working composition (hereinafter usually abbreviated as "M/kg") and independently, primarily for reasons of economy, contains a concentration of not more than, with increasing preference in the order given, 0.75, 0.60, 0.45, 0.40, 0.35, 0.30, 0.25, 0.20, 0.180, 0.170, 0.160, 0.150, or 0.140 M/kg of acid fluoride ions. In determining these concentrations, all material originally added to the composition in the form of a dissolved acid fluoride salt is assumed still to constitute acid fluoride ions in the composition, irrespective of any reaction as assumed below between the acid fluoride ions and stronger acids.

The acid stronger than acid fluoride ions required for component (B) preferably is, primarily for reasons of economy, selected from the group consisting of sulfuric acid, acid sulfate ions, nitric acid, and sulfonic acids, more preferably from sulfuric acid and acid sulfate ions. Acid sulfate ions may be generated by combining sulfuric acid with an amount of alkali that is not sufficient to neutralize the acid completely, and/or by supplying both acid and sulfate ions in appropriate amounts. For reasons of economy, if sulfate and/or acid sulfate salts are used, ammonium, potassium, and sodium hydrogen sulfates are preferred, with sodium most preferred. Generally, however, it is most economical and therefore most preferred to supply all of the total of sulfuric acid and acid sulfate ions present in a composition according to the invention by addition to a precursor liquid composition of sulfuric acid itself or an aqueous solution of it. Any acid sulfate present in the composition is then formed in situ in the liquid precursor composition by ionization of the sulfuric acid and/or (assumed) chemical reaction between sulfuric acid and at least some of the acid fluoride ions that constitute component (A).

Although sulfonic acids and other types of mixed organic-inorganic acids can be suitable sources of component (B), if they have surfactant properties and there are adequate other sources of component (B) in the compositions, any acids with strong surfactant properties are preferably considered as part of component (C) instead, when evaluating compositions according to the invention for their degree of preference in terms of quantitative relations involving component (B). (Without restricting the invention to or being bound by any theory, it is presumed that this separation of functions makes it possible separately to optimize the bulk and the surface characterstics of a composition according to the invention.) More specifically, if the constituents of a composition according to the invention include both (i) molecules which include a moiety that is a stronger acid than acid fluoride ions and also include a hydrophobe moiety, which is defined as a moiety consisting of (i.i) a group of at least 12 carbon atoms having the property that every carbon atom in the group is directly bonded to at least one other carbon atom in the group and (i.ii) all atoms other than carbon atoms which are directly bonded to any one of the carbon atoms in the group defined in (i.i), said other atoms including no atoms other than hydrogen atoms and halogen atoms and (ii) molecules which include a moiety that is a stronger acid than acid fluoride ions but do not include any hydrophobe moiety as defined for part (i), only the molecules of part (ii) are considered as constituents of component (B) of a composition according to the invention as described above, and the molecules of part (i) are instead considered part of component (C).

When sulfuric acid is essentially the only original source of component (B) as is normally most preferred, the molar ratio of sulfuric acid to acid fluoride ions present in a composition according to the invention (assuming, for the purpose of defining this molar ratio, no reaction between sulfuric acid and acid fluoride ions) preferably is at least, with increasing preference in the order given, 0.070:1.0, 0.15:1.0, 0.25:1.0, 0.35:1.0, 0.40:1.0, 0.45:1.0, 0.50:1.0, 0.55:1.0, 0.60:1.0, 0.65:1.0, 0.70:1.0, or 0.75:1.0 and independently preferably is not more than, with increasing preference in the order given, 5.0:1.0, 3.0:1.0, 2.0:1.0, 1.50:1.0, 1.00:1.0, 0.95:1.0, 0.90:1.0, 0.85:1.0, or 0.80:1.0. If sulfuric acid is not the only original source of component (B) in a composition according to the invention, the preferred amount of component (B) is instead defined by comparison of the composition according to the invention, or of some solution of it in water, to a hypothetical or actual "pH-equivalent-reference composition". The pH-equivalent-reference composition is defined to have the same ingredients in the same amounts as the actual composition according to the invention, except for replacing any constituent of component (B) that is not derived from addition of sulfuric acid to the composition itself or to a precursor composition for it by an amount of sulfuric acid such that the pH-equivalent-reference composition has the same pH value as the actual composition according to the invention or solution of it in water. If this pH-equivalent-reference composition has a molar ratio of sulfuric acid to acid fluoride ions that is within the preferred limits described above for compositions according to the invention in which sulfuric acid is the only source of component (B), then the composition according to the invention including some other source of component (B) is correspondingly as preferred among compositions according to the invention that contain at least one subcomponent in component (B) that is not derived from addition to the composition or to a precursor composition for it of sulfuric acid as the pH-equivalent-reference composition for it is preferred among compositions according to the invention in which component (B) is derived exclusively from addition to the composition or to a precursor composition for it of sulfuric acid.

The presence of surfactant component (C) in a composition according to the invention is generally preferred, because such an ingredient is often needed to solubilize some soil removed by the brightening composition according to the invention during its use. Surfactant(s) also promote uniform wetting of the surfaces being brightened by a composition according to the invention, and, if properly selected, can also promote formation of stable foams of the composition, as is generally desired. In a concentrate composition according to the invention, it is preferred for component (C) to comprise, more preferably to consist essentially of, or still more preferably to consist of, three different types of surfactants, specifically:

(C. 1) a subcomponent of nonionic surfactant selected from the group consisting of molecules each of which consists of: (i) at least one, preferably exactly one, monoalkylphenyl moiety, which is joined through (ii) an ether oxygen bond to (iii) an actual or formal polymer of monomers selected from the group consisting of ethylene oxide, propylene oxide, and both ethylene and propylene oxides; more preferably the alkyl part of the monoalkylphenyl moiety (i. 1) is straight chain, (i.2) independently has at least, with increasing preference in the order given, 5, 6, 7, 8, or 9 carbon atoms; and (i.3) independently preferably has not more than, with increasing preference in the order given, 15, 12, 11, 10, or 9 carbon atoms; also independently, part (ii) of the above description of the molecules from which this subcomponent is selected is a homopolymer of ethylene oxide with a number of carbon atoms that is at least, with increasing preference in the order given, 6, 8, 10, 12, 14, 16, or 18 and independently preferably is not more than 34, 30, 26, 24, 22, or 20;

(C.2) a subcomponent of first anionic surfactant molecules selected from the group consisting of linear alkylbenzene sulfonic acids and their salts, wherein the alkyl group has a number of carbon atoms that is at least, with increasing preference in the order given, 6, 7, 8, 9, or 10 and independently preferably is not more than, with increasing preference in the order given, 22, 20, 18, or 16; and (C.3) a subcomponent of second anionic surfactant with hydrotroping properties to promote the solubilization of subcomponents (C. 1) and/or (C.2), this subcomponent of second anionic surfactant independently preferably being selected from the group consisting of (i) alkali metal salts of alkylarene, preferably alkylbenzene, sulfonic acids, wherein the alkyl group has from 1 to 4 carbon atoms and most preferably is an isopropyl group and (ii) alkali metal salts of partial esters of sulfuric and phosphoric acids with ether alcohols having a structure that formally corresponds to an adduct of one or more alkylene oxides with a monoalkyl substituted phenol.

When subcomponents (C. 1) and (C.2) are both present in a composition according to the invention, as they preferably are, the ratio of (C. 1) to (C.2) preferably is not more than, with increasing preference in the order given, 0.50:1.0, 0.40:1.0, 0.35:1.0, 0.30:1.0, 0.25:1.0, 0.20:1.0, 0.180:1.0, 0.160:1.0, 0.150:1.0, 0.140:1.0, 0.136:1.0, or 0.133:1.0 and independently preferably is at least, with increasing preference in the order given, 0.010:1.0, 0.030:1.0, 0.050:1.0, 0.070:1.0, 0.080:1.0, 0.090:1.0, 0.100:1.0, 0.110:1.0, 0.115:1.0, 0.120:1.0, 0.124:1.0, or 0.127:1.0. Independently, the total concentration of subcomponents (C. 1) and (C.2) in a working composition according to the invention preferably is at least, with increasing preference in the order given, 0.5, 1.0, 1.5, 2.0, 2.5, 3.0, 3.5, 4.0, or 4.4 g/kg and independently preferably is, primarily for reasons of economy, not more than, with increasing preference in the order given, 30, 20, 10, 8.0, 7.0, 6.5, 6.0, 5.5, 5.0, or 4.6 g/kg.

Subcomponent (C.3) has less effect on the quality of the results obtained in a working composition according to the invention and could reasonably be omitted if a working composition were made up directly from the basic ingredients. However, preferred subcomponents (C. 1) and (C.2) have fairly low solubilities in water, so that when preparing a concentrate composition according to the invention, subcomponent (C.3) is preferably also present, because it promotes increased solubility of the other two surfactant subcomponents. More particularly, in a concentrate composition according to the invention, and therefore in a working composition according to the invention made from a single package concentrate, the ratio of the content of subcomponent (C.3) to the total of subcomponents (C. 1) and (C.2) preferably is at least, with increasing preference in the order given, 0.04:1.0, 0.08:1.0, 0.15:1.0, 0.20:1.0, 0.25:1.0, 0.30:1.0, 0.35:1.0, 0.38:1.0, or 0.42:1.0 and independently preferably is, primarily for reasons of economy, not more than, with increasing preference in the order given, 4.0:1.0, 3.0:1.0, 2.0:1.0, 1.5:1.0, 1.0:1.0, 0.80:1.0, 0.70:1.0, 0.60:1.0, 0.55:1.0, 0.50:1.0, 0.46:1.0, or 0.43:1.0.

Oxidizing agent component (D) is not normally needed and therefore normally is preferably omitted from compositions according to the invention. However, if the metal surfaces to be treated have been subjected to highly reducing environments, component (D) may be useful to restore brightness by oxidizing dulling films formed on the metallic surface, and in that instance is preferably selected from peroxy compounds. Hydrogen peroxide is generally most preferred, primarily for reasons of economy and ready availability, and also because it appears to have at least a slight solubilizing property for surfactant subcomponents (C.1) and/or (C.2).

One preferred method of using the invention includes steps of applying a working composition according to the invention as described above as a foam to the surface to be cleaned and, after an appropriate contact time, applying to the foam a neutralizer to bring its pH value closer to neutral for safer disposition and rinsing. When a composition according to the invention is expected to be used in this manner, optional pH indicator component (E) is preferably present in the composition, to provide a convenient visual indication of completion of the neutralization process. Conventional indicators such as phenolphthalein and phenol red may be effectively used for this purpose. About 0.5 g/kg of indicator is generally adequate and preferred. Independently, when a working composition according to the invention is expected to be used in this manner, its surfactant components are preferably chosen so that a foam formed from the working composition will, unless it is sooner neutralized, be stable against draining substantially completely, under the influence of natural gravity, from any part of a metallic surface to be brightened to which it is applied for a time of at least, with increasing preference in the order given, 2, 5, 10, 15, 20, or 30 minutes after it has been applied.

For convenience, economy, and safety, neutralization after completion of the desired time of contact with a working brightening composition according to the invention is preferably performed with an aqueous neutralizer solution comprising, or preferably consisting essentially of, neutralizing agents selected from the group consisting of ammonium and alkali metal carbonates, acid carbonates, phosphates, acid phosphates, condensed phosphates, acid condensed phosphates, borates, acid borates, condensed borates, and acid condensed borates, optionally with surfactants. The carbonates are most economical and therefore preferably constitute the bulk of the neutralizing agent in the neutralizer solution, but some content of the other materials noted is usually desirable to provide better complexing power for multivalent metal ions that may be dissolved into the brightening composition and then redeposit in the form of sparingly water soluble metal carbonates on the cleaned surface when neutralized with carbonates only. Any such redeposit would diminish the brightness desired after completion of a process according to the invention.

In addition to their cleaning effect, sulfuric acid and the anions formed from its ionization are generally effective in repressing the growth of micro-organisms that introduce themselves into a composition according to the invention from the ambient air. Therefore, separate biocidal component (F) is not generally needed in, and therefore at least for reasons of economy is preferably omitted from, a composition according to the invention that contains substantial amounts of sulfur in the form of sulfuric acid and the anions derived from it. For operations in environments rich in micro-organisms that thrive on sulfur, however, a separate biocidal component may be advantageously present in a composition according to the invention.

Optional component (G) is not normally required for any technical reason, but may be aesthetically advantageous for certain uses of compositions according to the invention. For example, neutralization of a preferred composition containing ammonium acid fluoride may release small quantities of pungent smelling ammonia, for which a masking odorant could be desirable, or a permanent colorant could make the transition of a pH indicator easier to see.

Optional component (H) is generally not needed and therefore not preferred if subcomponent (C. 3) is present as preferred. In the absence of any surfactant with hydrotroping properties, however, some non-surfactant hydrotroping agent such as alcohols, glycols, or the like may be advantageously employed in compositions according to the invention to avoid phase separations that might otherwise occur.

Independently of the other preferences stated above, a working composition according to the invention preferably has a pH value that is at least, with increasing preference in the order given, 1.0, 1.4, 1.7, 1.9, 2.1, 2.3, 2.5, or 2.6 and independently preferably is, with increasing preference in the order given, not more than 7.0, 6.0, 5.5, 5.0, 4.8, 4.6, 4.4, 4.2, 4.0, 3.8, 3.6, 3.4, 3.2, 3.0, or 2.8.

For various reasons, it is often preferred that many ingredients used in other cleaning compositions should not be present in compositions according to the invention. Specifically, it is increasingly preferred in the order given, independently for each preferably minimized type of material listed below, that compositions according to the invention contain no more than 10, 5, 3, 2.0, 1.0, 0.60, 0.35, 0.10, 0.08, 0.04, 0.02, 0.01, 0.005, 0.002, or 0.001 percent of each of the following materials: unneutralized alkali metal, alkaline earth metal, and ammonium hydroxides (likely to promote too vigorous an attack on the metallic substrates to be brightened); phosphoric acids, mono- and di-hydrogen phosphates, phosphates, and condensed phosphates (all of these phosphorus-containing materials are capable of forming low solubility salts with some of the constituents of most of the metallic surfaces to be brightened, and such salts can dull the desired brightness); any chemical form of any metals other than alkali and alkaline earth metals (these also increase the possibility of forming dulling films); hydrochloric, hydrobromic, and hydriodic acids and their soluble salts (all of these can cause pitting corrosion of many types of metallic surfaces that are to be brightened); alcohols, ethers, ether alcohols, hydrocarbons, halocarbons, halohydrocarbons, aldehydes, ketones, carboxylic acids and their salts, synthetic polymers, and compounds containing heterocyclic organic rings with heteroatoms other than oxygen, unless they are part of one of the necessary or optional components of compositions according to the invention as described above (all of these materials, if present in substantial quantities, are likely to require pollution abatement in many localities); and silicates and oxides of silicon (likely to have a dulling effect).

A process according to the invention normally, primarily for convenience, is preferably performed at whatever ambient temperature is naturally prevailing, provided that this temperature is not too low for the brightening composition used to remain liquid. Preferably, the brightening composition is used at a temperature of at least, with increasing preference in the order given, 10°, 15°, 20°, 25°, or 30 ° C. Brightening and cleaning effectiveness generally increases with increasing temperature of use, up to at least 50 ° C. Preferably, the use temperature is not more than 55 ° C.

A concentrate composition according to the invention preferably consists of all the components and subcomponents (A) through (H) as described above (including optionality if applicable) in amounts from 10 to 20 times the amounts of the same component or subcomponent as specified above for a working composition.

The invention is illustrated in greater detail below by working examples, and the benefits of the invention may be further appreciated by comparison with other cleaners, including those illustrated in the comparisons below.

EXAMPLES AND COMPARISON EXAMPLES

Various test compositions, of which those according to the invention are concentrates, were prepared with amounts of ingredients as shown in Table 1 below. The ingredients shown in Table 1 were dissolved in some of the water to constitute the final composition, stirred moderately until there was no further evidence of separate stratifying phases (if possible within a reasonable time), diluted with additional water if needed to make up the mass of the composition to a total of 100 %, and then evaluated for clarity, with results as shown in Table 1.

Ingredients in Table 1 not identified by chemical names were obtained from the following sources:

Calsoft™ LAS-99 surfactant was obtained commercially from Van Waters and Rogers (hereinafter usually abbreviated as "VW&R"), Kirkland, Wash. and was reported by its supplier to contain about 97 % of dodecylbenzenesulfonic acid and about 1 % of sulfuric acid;

Naxonate™ SC was obtained commercially from Ruetgers-Nease Chemical Co., Inc., Ross, Ohio and was reported by its supplier to be 93 % sodium cumene sulfonate;

TABLE 1

| | Percent of Ingredient in Composition #: | | | | | |
|---|---|---|---|---|---|---|
| Ingredient | 1.1 | 1.2 | 1.3 | 1.4 | 1.5 | 1.6 |
| Ammonium acid fluoride | 7.0 | 7.0 | 7.0 | 7.0 | 7.0 | 7.0 |
| Aqueous sulfuric acid, 93% $H_2SO_4$ | 10.0 | 10.0 | 10.0 | 10.0 | 10.0 | 10.0 |
| Calsoft ™ LAS-99 surfactant | 5.0 | 5.0 | 5.0 | 5.0 | 5.0 | 5.0 |
| Monamine ™ ALX-100S surfactant | 2.0 | 2.0 | 2.0 | 2.0 | 2.0 | 6.0 |
| Triton ™ N-101 surfactant | — | — | 2.0 | — | — | — |
| Triton ™ H-66 surfactant | — | — | — | 2.0 | — | — |
| Triton ™ QS-44 surfactant | — | — | — | — | 2.0 | — |
| Petro ™ BA surfactant | — | 2.0 | — | — | — | — |
| Transparency Rating | M, S | M | M | M | M | M |

| | Percent of Ingredient in Composition #: | | | | | |
|---|---|---|---|---|---|---|
| Ingredient | 2.1 | 2.2 | 2.3 | 2.4 | 2.5 | C.1 |
| Ammonium acid fluoride | 7.0 | 7.0 | 7.0 | 7.0 | 7.0 | — |
| Aqueous sulfuric acid, 93% $H_2SO_4$ | 10.0 | 10.0 | 10.0 | 10.0 | 10.0 | 10.0 |
| Calsoft ™ LAS-99 surfactant | 5.0 | 5.0 | 5.0 | 5.0 | 5.0 | — |
| Monamine ™ ALX-100S surfactant | — | — | 4.0 | 4.0 | — | — |
| Naxonate ™ SC hydrotroping surfactant | — | 2.0 | 4.0 | — | 2.6 | 2.0 |
| Transparency Rating | M | T | T | C | T | T |

| | Percent of Ingredient in Composition #: | | | | | |
|---|---|---|---|---|---|---|
| Ingredient | C.2 | C.3 | C.4 | C.5 | C.6 | C.7 |
| Ammonium acid fluoride | — | — | — | — | — | — |
| Aqueous sulfuric acid, 93% $H_2SO_4$ | 10.0 | 10.0 | 10.0 | 10.0 | 10.0 | 10.0 |
| Calsoft ™ LAS-99 surfactant | — | 5.0 | — | — | 5.0 | 5.0 |
| Naxonate ™ SC hydrotroping surfactant | — | — | — | — | 2.6 | — |
| Igepal ™ CO-880 surfactant | — | — | — | 5.0 | — | — |
| Dowfax ™ 2A1 surfactant | 4.0 | — | — | — | — | — |
| APG ® 325 surfactant | — | — | 5.0 | — | — | 4.0 |
| Transparency Rating | T | C | T | T | T | T |

| | Percent of Ingredient in Composition #: | | | | | |
|---|---|---|---|---|---|---|
| Ingredient | 3 | 4 | 5 | 6 | 7 | 8 |
| Ammonium acid fluoride | 7.0 | 7.0 | 7.0 | 7.0 | 7.0 | 6.0 |
| Aqueous sulfuric acid, 93% $H_2SO_4$ | 10.0 | 10.0 | 10.0 | 10.0 | 5.0 | 9.0 |
| Calsoft ™ LAS-99 surfactant | 4.0 | 4.0 | 4.0 | 4.0 | 5.0 | 4.0 |
| Naxonate ™ SC hydrotroping surfactant | 2.0 | 2.0 | 2.0 | 4.0 | 2.0 | 2.0 |
| Triton ™ N-101 surfactant | 0.5 | — | — | — | 1.0 | 0.4 |
| Aqueous nitric acid, 70% $HNO_3$ | — | — | 3.0 | 6.0 | — | — |
| 30% Solution of $H_2O_2$ in water | 5.0 | — | — | — | 6.0 | 5.0 |
| Transparency Rating | T | T | T | T | T | T |

| | Percent of Ingredient In Composition #: | | | | |
|---|---|---|---|---|---|
| Ingredient | 9 | 10 | 11 | 12 | 13 |
| Ammonium acid fluoride | 5.0 | 4.0 | 6.0 | 6.0 | 7.0 |
| Aqueous sulfuric acid, 93% $H_2SO_4$ | 9.0 | 9.0 | 9.0 | 7.0 | 10.0 |
| Calsoft ™ LAS-99 surfactant | 4.0 | 4.0 | 4.0 | 4.0 | 4.0 |
| Naxonate ™ SC hydrotroping surfactant | 2.0 | 2.0 | 2.0 | 2.0 | 2.0 |
| Triton ™ N-101 surfactant | 0.5 | 0.5 | 0.5 | 0.5 | 0.5 |
| 30% Solution of $H_2O_2$ in water | 5.0 | 5.0 | 5.0 | 5.0 | — |
| 1% Phenolphthalein in Propylene Glycol | — | — | — | — | 5.0 |
| Transparency Rating | T | T | T | T | T |

Abbreviations for Table 1
M = milky; S = stratifies into two liquid phases; T = transparent; C = cloudy but not stratified.

Triton™ N-101 was commercially supplied by VW&R and was reported by its supplier to be a nonionic surfactant consisting of polyethoxylated nonylphenol with residues from an average of 9.5 molecules of ethylene oxide per molecule of surfactant;

Triton™ H-66 was commercially supplied by VW&R and was reported by its supplier to be a potassium salt of a partial phosphate ester of an adduct of ethylene oxide with an alkyl phenol;

Triton™ QS-44 was commercially supplied by VW&R and was reported by its supplier to be at least 65 % of a partial phosphate ester with an adduct of ethylene oxide and octylphenol; Petro™ BA was commercially supplied by Joseph Turner & Company, Itasca, Ill. and was reported by its supplier to be predominantly sodium salts of alkylnaphthalene sulfonic acids;

Monamine™ ALX-100S was commercially supplied by Mona Industries, Paterson, N.J. and was reported by its supplier to consist predominantly of cocamide and diethanol amine;

Igepal™ CO-880 was commercially supplied by Rhône-Poulenc and was reported by its supplier to be alkoxylated nonyl phenol;

Dowfax™ 2A1 was commercially supplied by Dow Chemical Co. and was reported by its supplier to be sodium salts of disulfonated tetrapropylene derivatives of 1,1 -oxy-bis-benzene;

APG® 325 was commercially supplied by Henkel Corp., Emery Group, Cincinnati, Ohio and is a 9 to 11 carbon substituted polyglucose with an average degree of polymerization between 1 and 2.

Working compositions were made from many of the concentrates shown in Table 1 by dilution with water to provide a working composition containing 10 % of the concentrate with the same identifying number. These were tested during 5 minute contact times at ambient temperature on soiled panels of an aluminum alloy actually used in rail cars belonging to the Bay Area Rapid Transit system in California. The degree of brightening and cleaning achieved was rated subjectively by a single observer, with the results shown in Table 2.

TABLE 2

| Working Composition Number | Brightening Effect Rating |
|---|---|
| 3 | Good to excellent |
| 4 | Fair |
| 5 | Fair to good |
| 6 | Good |
| 7 | Fair to good |
| 8 | Good |
| 9 | Fair |
| 10 | Poor to fair |
| 11 | Good |
| 12 | Fair |
| 13 | Good to Excellent |

The foaming characteristics of some of the compositions shown in Table 1 were also evaluated by placing a 100 milliliter (hereinafter usually abbreviated as "mL") sample in a glass stoppered graduated cylinder of 500 ml capacity, shaking vigorously ten times with the stopper in place, then returning the cylinder to a position resting on its base, and noting the foam volume as soon as possible thereafter. The foam volume was again noted after the cylinder had sat without further mechanical disturbance for 15 minutes. Results are shown in Table 3 below and indicate that some of the compositions according to the invention produce foams that are stable for at least the preferred time of contact between a composition according to the invention and a metal substrate to be brightened as described above.

TABLE 3

| | Volume in Milliliters of Sample Including Foam | |
|---|---|---|
| Composition Number | Immediately After Shaking | After 15 Minutes |
| 2.2 | 250 | 150 |
| 2.3 | 475 | 350 |
| 2.5 | 430 | 360 |
| C3 | 470 | 315 |
| C4 | 350 | 270 |
| C5 | 270 | 150 |
| C6 | 500 | 300 |
| C7 | 375 | 275 |

The invention claimed is:

1. A process of brightening an unpainted dulled metal surface, which is in a fixed spatial position with respect to at least one glass surface, by contacting the dulled metal surface with an aqueous liquid brightening composition and maintaining contact between the liquid brightening composition and the dulled metal surface for a specified time, the contacting of the dulled metal surface being by a method that also results in contacting at least part of the glass surface with respect to which the dulled metal surface is in a fixed spatial position, wherein the improvement comprises utilizing as the aqueous liquid brightening composition a composition that comprises water and:

(A) $HF_2^-$ions not provided directly by hydrogen fluoride or its aqueous solutions; and (B) a component of acid(s) with a higher ionization constant than $HF_2^-$ions, said aqueous liquid brightening composition not comprising more than 10 % of hydrochloric acid.

2. A process according to claim 1, wherein the aqueous liquid brightening composition consists essentially of water and:

(A) $HF_2^-$ions not provided directly by hydrogen fluoride or its aqueous solutions;

(B) a component of acid(s) with a higher ionization constant than $HF_2^-$ions, exclusive of any such acid that is (i) a sulfonic acid including a hydrophobe moiety containing at least 12 carbon atoms but no atoms other than carbon, hydrogen, and halogen atoms or (ii) a partial ester of an inorganic acid, said inorganic acid having more than one hydrogen moiety neutralizable by sodium hydroxide in water solution, with an alcohol including a hydrophobe moiety containing at least 12 carbon atoms but no atoms other than carbon, hydrogen, and halogen atoms; and (C) a component of surfactant molecules, exclusive of any that are part of any of the previously recited components; and, optionally, one or more of:

(D) a component of oxidizing agent(s), exclusive of any that are part of any of the previously recited components;

(E) a component of pH indicator colorant, exclusive of any that is part of any of the previously recited components;

(F) a component of biocidal material(s), exclusive of any that are part of any of the previously recited components;

(G) odorant(s) and/or colorant(s), other than those that are part of any of the previously recited components; and (H) a component of agent(s), other than those that are part of any of the previously recited components, component (A) being present in the aqueous liquid brightening composition in a concentration from about 0.010 to about 0.75 moles per kilogram of the total composition, component (B) being present in the aqueous liquid brightening composition in a concentration such that, in a pH-equivalent reference composition for said aqueous liquid brightening composition, sulfuric acid and acid fluoride ions are present in molar concentrations having a ratio to each other in a range from about 0.070:1.0 to about 5.0:1.0, said pH-equivalent reference composition being defined as that having the same ingredients as said aqueous liquid brightening composition except that any part of the original source of component (B) in said aqueous liquid brightening composition that was not sulfuric acid has been replaced by an amount of sulfuric such that the pH-equivalent-reference composition has the same pH as said aqueous liquid brightening composition.

3. A process according to claim 2, wherein component (C) comprises:

(C.1) a subcomponent of nonionic surfactant selected from the group consisting of molecules, each of which consists of the following three parts: (i) at least one monoalkylphenyl moiety, (ii) an ether oxygen atom, and (iii) a polymer of monomers that are selected from the group consisting of ethylene oxide, propylene oxide, or both, with parts (i) and (iii) being joined through the ether oxygen atom; and (C.2) a subcomponent of first anionic surfactant molecules selected from the group consisting of linear alkylbenzene sulfonic acids and their salts, wherein the alkyl group has from about 6 to about 16 carbon atoms, subcomponents (C.1) and (C.2) being present in concentrations such that (i) the concentration of (C.1) has a ratio to the concentration of (0.2) that is from about 0.010:1.0 to about 0.50:1.0 and the concentrations of (C.1) and (C.2) have a sum that is from about 0.5 to about 30 parts per thousand by weight.

4. A process according to claim 3, wherein: the concentration of component (A) is from about 0.030 to about 0.45 moles per kilogram of the total composition; component (B) is present in the aqueous liquid brightening composition in a concentration such that, in the pH-equivalent-reference composition for said aqueous liquid brightening composition, sulfuric acid and acid fluoride ions are present in molar concentrations having a ratio to each other in a range from about 0.15:1.0 to about 3.0:1.0; the concentration of (C.1) has a ratio to the concentration of (C.2) that is from about 0.050:1.0 to about 0.30:1.0; and the concentrations of (C.1) and (C.2) have a sum that is from about 1.0 to about 20 parts per thousand by weight.

5. A process according to claim 4, wherein: subcomponent (C.1) is selected from molecules each of which has the following two characteristics: (i) a straight chain alkyl group with from 6 to 12 carbon atoms as the alkyl part of each monoalkylphenyl moiety and (ii) a homopolyrner of ethylene oxide with from 4 to 30 carbon atoms as its polymer of monomers that are selected from the group consisting of ethylene oxide, propylene oxide, or both; and subcomponent (C.2) is selected from linear alkylbenzene sulfonic acids and their salts wherein the alkyl group of the alkylbenzene sulfonic acid has from 8 to 18 carbon atoms per molecule.

6. A process according to claim 5, wherein: the concentration of component (A) is from about 0.050 to about 0.35 moles per kilogram of the total composition; component (B) is present in the aqueous liquid brightening composition in a concentration such that, in the pH-equivalent-reference composition for said aqueous liquid brightening composition, sulfuric acid and acid fluoride ions are present in molar concentrations having a ratio to each other in a range from about 0.40:1.0 to about 2.0:1.0; the concentration of (C.1) has a ratio to the concentration of (C.2) that is from about 0.070:1.0 to about 0.25:1.0 and the concentrations of (C.1) and (C.2) have a sum that is from about 2.0 to about 10 parts per thousand by weight.

7. A process according to claim 6, wherein: the concentration of component (A) is from about 0.070 to about 0.25 moles per kilogram of the total composition; component (B) is present in the aqueous liquid brightening composition in a concentration such that, in the pH-equivalent-reference composition for said aqueous liquid brightening composition, sulfuric acid and acid fluoride ions are present in molar concentrations having a ratio to each other in a range from about 0.50:1.0 to about 1.5:1.0; the concentration of (C.1) has a ratio to the concentration of (C.2) that is from about 0.070:1.0 to about 0.25:1.0, and the concentrations of (C.1) and (C.2) have a sum that is from about 2.0 to about 10 g/kg.

8. A process according to claim 7, wherein component (A) consists essentially of acid fluoride ions and component (B) consists essentially of sulfur containing materials derived by addition of sulfuric acid during preparation of the aqueous liquid brightening composition.

9. A process according to claim 8, wherein: the aqueous liquid brightening composition has a concentration of acid fluoride ions in a range from about 0.100 to about 0.180 moles per kilogram of the total composition; sulfuric acid is present in the aqueous liquid brightening composition in a concentration, such that there is, in the composition, a molar ratio of sulfuric acid acid fluoride ions that is in a range from about 0.60:1.0 to about 0.90:1.0; the concentration of (C.1) has a ratio to the concentration of (C.2) that is from about 0.110:1.0 to about 0.150:1.0, and the concentrations of (C.1) and (C.2) have a sum that is from about 3.5 to about 5.0 g/kg.

10. A process according to claim 9, wherein: the aqueous liquid brightening composition has a pH value in the range from about 2.3 to about 3.4 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

11. A process according to claim 1, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening compositions when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

12. A process according to claim 8, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

13. A process according to claim 7, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

14. A process according to claim 6, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

15. A process according to claim 5, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

16. A process according to claim 4, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

17. A process according to claim 3, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

18. A process according to claim 2, wherein: the aqueous liquid brightening composition has a pH value in the range from about 1.0 to about 6.0 and includes a sufficient amount of an acid-base indicator to cause a visible color change when the pH value is altered to a value greater than 7.0 by addition of alkalinizing agents; the aqueous liquid brightening composition, when it is brought into contact with the dulled metal surface to be brightened, is in the form of a foam which resists drainage under the influence of natural gravity for at least 10 minutes after application of the foam to the dulled metal surface; and, after completion of a selected contact time, the foam of the aqueous liquid brightening composition is sprayed with an aqueous alkaline composition to raise its pH to a value at which the acid-base indicator contained in the aqueous liquid brightening composition undergoes said visible color change.

* * * * *